US012442053B2

(12) United States Patent
Watanabe et al.

(10) Patent No.: US 12,442,053 B2
(45) Date of Patent: Oct. 14, 2025

(54) GRAIN-ORIENTED ELECTRICAL STEEL SHEET, METHOD FOR MANUFACTURING GRAIN-ORIENTED ELECTRICAL STEEL SHEET, AND METHOD FOR EVALUATING GRAIN-ORIENTED ELECTRICAL STEEL SHEET

(71) Applicant: JFE STEEL CORPORATION, Tokyo (JP)

(72) Inventors: Makoto Watanabe, Tokyo (JP); Takashi Terashima, Tokyo (JP); Karin Kokufu, Tokyo (JP)

(73) Assignee: JFE STEEL CORPORATION, Tokyo (JP)

( * ) Notice: Subject to any disclaimer, the term of this patent is extended or adjusted under 35 U.S.C. 154(b) by 364 days.

(21) Appl. No.: 18/031,246

(22) PCT Filed: Jul. 26, 2021

(86) PCT No.: PCT/JP2021/027500

§ 371 (c)(1),
(2) Date: Apr. 11, 2023

(87) PCT Pub. No.: WO2022/085263

PCT Pub. Date: Apr. 28, 2022

(65) Prior Publication Data

US 2023/0392223 A1 Dec. 7, 2023

(30) Foreign Application Priority Data

Oct. 21, 2020 (JP) ..... 2020-176601

(51) Int. Cl.

| | |
|---|---|
| ***C21D 6/00*** | (2006.01) |
| ***C21D 9/46*** | (2006.01) |
| ***C22C 38/02*** | (2006.01) |
| ***C22C 38/04*** | (2006.01) |

(52) U.S. Cl.

CPC ..... *C21D 6/008* (2013.01); *C21D 9/46* (2013.01); *C22C 38/02* (2013.01); *C22C 38/04* (2013.01); *C21D 2201/05* (2013.01)

(58) Field of Classification Search

CPC ..... C21D 6/008; C21D 9/46; C21D 2201/05; C21D 8/1277; C21D 8/1283; C22C 38/02; C22C 38/04; C22C 38/002; C22C 38/008; C22C 38/16; C22C 38/08; C22C 38/12; C22C 38/14; C22C 38/34; C22C 38/60; C22C 38/42; C22C 38/44; C22C 38/50; G01N 2203/0282; G01N 3/56; G01N 19/04; G01N 19/02; G01N 33/20; C09D 1/00; C23C 22/22; C23C 22/37; C23C 22/38; C23C 22/74; H01F 1/14775; H01F 1/16; H01F 1/147

See application file for complete search history.

(56) References Cited

U.S. PATENT DOCUMENTS

| | | | |
|---|---|---|---|
| 3,985,583 | A | 10/1976 | Shimanaka et al. |
| 4,958,511 | A | 9/1990 | Marcus |
| 5,955,201 | A | 9/1999 | Loudermilk et al. |
| 2003/0136470 | A1 | 7/2003 | Takashima et al. |
| 2013/0189490 | A1 | 7/2013 | Watanabe et al. |
| 2019/0271087 | A1 | 9/2019 | Takeda et al. |
| 2020/0086343 | A1 | 3/2020 | Fluch et al. |
| 2020/0176156 | A1 | 6/2020 | Takatani et al. |

FOREIGN PATENT DOCUMENTS

| | | | |
|---|---|---|---|
| CN | 110832112 | A | 2/2020 |
| DE | 102017204522 | A1 | 9/2018 |
| JP | S60-218051 | A | 10/1985 |
| JP | H09-192602 | A | 7/1997 |
| JP | H10-166150 | A | 6/1998 |
| JP | H11-222654 | A | 8/1999 |
| JP | 3663784 | B2 | 6/2005 |
| JP | 2005-240157 | A | 9/2005 |
| JP | 5328375 | B2 | 10/2013 |
| JP | 5652117 | B2 | 1/2015 |
| JP | 2017-137540 | A | 8/2017 |
| JP | 2018-28140 | A | 2/2018 |
| JP | 6682892 | B2 | 4/2020 |
| WO | 2019/013354 | A1 | 1/2019 |

OTHER PUBLICATIONS

Oct. 5, 2021 Search Report issued in International Patent Application No. PCT/JP2021/027500.

Aug. 12, 2024 Extended European Search Report issued in European Patent Application No. 21882404.3.

Simko et al., Surface and Tribological Characterization of Coatings for Friction and Wear Reduction, SAE Technical Papers, SAE International.

Apr. 25, 2024 Partial Supplementary Search Report issued in European Patent Application No. 21882404.3.

Oct. 16, 2024 Office Action issued in Chinese Patent Application No. 202180068568.5.

Dangsheng Xiong et al., "Solid Lubricant Coating Technology Under Extreme Environment", National Defence Industry Press, (2016), pp. 247-248.

*Primary Examiner* — Adil A. Siddiqui
(74) *Attorney, Agent, or Firm* — Oliff PLC

(57) ABSTRACT

A grain oriented electrical steel sheet has excellent insulation property and includes: a steel sheet; and a coating disposed on each of both surfaces of the steel sheet, wherein an interlaminar current value after a rubbing test is not more than 0.10 A, the rubbing test being conducted by stacking two sheets of the grain oriented electrical steel sheet and rubbing the two sheets against each other to make 90 reciprocations under conditions of a surface pressure of 200 Pa, a rubbing speed of 0.10 m/s, and a reciprocating stroke of 50 mm.

14 Claims, No Drawings

GRAIN-ORIENTED ELECTRICAL STEEL SHEET, METHOD FOR MANUFACTURING GRAIN-ORIENTED ELECTRICAL STEEL SHEET, AND METHOD FOR EVALUATING GRAIN-ORIENTED ELECTRICAL STEEL SHEET

TECHNICAL FIELD

The present invention relates to a grain oriented electrical steel sheet, a method of producing a grain oriented electrical steel sheet, and a method of evaluating a grain oriented electrical steel sheet.

BACKGROUND ART

Generally, in a grain oriented electrical steel sheet, a coating is formed on each of both surfaces of a steel sheet to impart an insulation property or another property. An example of the coating as above is a so-called insulating coating formed on a forsterite coating, the forsterite coating being formed during finishing annealing in a process of producing a grain oriented electrical steel sheet.

Patent Literatures 1 and 2 each disclose an insulating coating formed by baking a coating liquid containing phosphate, colloidal silica, and chromic anhydride.

Since the foregoing insulating coating has a low thermal expansion coefficient, the insulating coating formed at high temperature followed by cooling applies tension to a steel sheet owing to the difference in thermal expansion coefficient from that of the steel sheet, thereby reducing the iron loss.

CITATION LIST

Patent Literature

Patent Literature 1: JP 56-52117 B
Patent Literature 2: JP 53-28375 B

SUMMARY OF INVENTION

Technical Problems

Grain oriented electrical steel sheets are, for example, stacked and used as a core (iron core) of a transformer.

In a case where grain oriented electrical steel sheets having insufficient insulation property (interlaminar insulation resistance) are stacked and used as a core of a transformer, generation of leakage current or partial discharge may occur.

Even when grain oriented electrical steel sheets have the insulation property of a level that does not matter in the inspection for product shipment, the grain oriented electrical steel sheets having been processed into a core of a transformer may have insufficient insulation property. Hence, there is a demand for grain oriented electrical steel sheets exhibiting good insulation property even after being processed into a core of a transformer.

The present invention has been made in view of the foregoing and has an object of providing a grain oriented electrical steel sheet having excellent insulation property.

Solution to Problems

The present inventors found, through an earnest study, that employing the configuration described below enables the achievement of the above-mentioned object, and the invention has been completed.

Specifically, the present invention provides the following [1] to [7].

[1] A grain oriented electrical steel sheet comprising: a steel sheet; and a coating disposed on each of both surfaces of the steel sheet, wherein an interlaminar current value after a rubbing test is not more than 0.10 A, the rubbing test being conducted by stacking two sheets of the grain oriented electrical steel sheet and rubbing the two sheets against each other to make 90 reciprocations under conditions of a surface pressure of 200 Pa, a rubbing speed of 0.10 m/s, and a reciprocating stroke of 50 mm.

[2] The grain oriented electrical steel sheet according to [1], wherein the coating has hardness of not more than 9.0 GPa.

[3] The grain oriented electrical steel sheet according to claim 1 or 2, wherein the coating has surface roughness with a maximum peak height Sp of not more than 6.0 μm.

[4] The grain oriented electrical steel sheet according to any one of [1] to [3], wherein the steel sheet has a steel composition containing, by mass, Si: 2.0 to 4.0% and Mn: 0.03 to 0.25%, with a balance being Fe and inevitable impurities.

[5] The grain oriented electrical steel sheet according to [4], wherein the steel composition further contains at least one selected from the group consisting of, by mass, Ni: not more than 1.50%, Cr: not more than Cu: not more than 0.50%, P: not more than 0.100%, Sb: not more than 0.500%, Sn: not more than 0.500%, Bi: not more than 0.100%, Mo: not more than 0.100%, Nb: not more than 0.0100%, V: not more than 0.010%, Ti: not more than 0.010%, and Ta: not more than 0.010%.

[6] A method of producing a grain oriented electrical steel sheet comprising forming a coating on each of both surfaces of a steel sheet by applying a coating liquid to the steel sheet, followed by baking at a temperature of not lower than 700° C., and cooling, while the steel sheet is transported, wherein a forward slip r in a transport region in which the steel sheet is cooled to a temperature of not higher than 600° C. is not more than 1.7%, and wherein in the coating liquid, a molar ratio M1/S of a content of a metal element M1 to a content of a silica S in terms of $SiO_2$ is not less than 0.15, a molar ratio M2/S of a content of a metal element M2 to the content of the silica S in terms of $SiO_2$ is not more than 0.15, and a molar ratio P/S of a content of a phosphoric acid component P in terms of $P_2O_5$ to the content of the silica S in terms of $SiO_2$ is not less than 0.20, the metal element M1 being at least one selected from the group consisting of Zn, Li, Mg, and Ca, and the metal element M2 being at least one selected from the group consisting of Zr, Ti, Cr, and Al.

[7] A method of evaluating a grain oriented electrical steel sheet comprising: a steel sheet; and a coating provided on each of both surfaces of the steel sheet, the method comprising conducting a rubbing test to obtain an interlaminar current value of the grain oriented electrical steel sheet after the rubbing test, and determining whether insulation property of the grain oriented electrical steel sheet is good or not based on the interlaminar current value obtained, the rubbing test being conducted by stacking two sheets of the grain oriented electrical steel sheet and rubbing the two sheets against each other to make 60 to 120 reciprocations under conditions of a surface pressure of 150 to 250 Pa, a rubbing speed of 0.05 to 0.15 m/s, and a reciprocating stroke of 30 to 70 mm.

Advantageous Effects of Invention

The present invention can provide a grain oriented electrical steel sheet having excellent insulation property.

DESCRIPTION OF EMBODIMENTS

[Findings Made by Inventors (Method of Evaluating Grain Oriented Electrical Steel Sheet)]

As test sheets, the present inventors prepared several types of grain oriented electrical steel sheets (including "grain oriented electrical steel sheet of the invention" to be described later) produced by various methods.

A grain oriented electrical steel sheet generally comprises a steel sheet and a coating (insulating coating) provided on each of both surfaces of the steel sheet, and hardness and surface roughness of the coating vary depending on the test sheet.

Subsequently, the respective test sheets were sheared by a bevel edge-forming shear line and then stacked to form a core (iron core), a transformer was prepared, and a current was applied to the transformer.

As a result, there were transformers in which leakage current or partial discharge occurred. In other words, there were test sheets exhibiting insufficient insulation property (interlaminar insulation resistance) after being processed into a core of a transformer.

In the meantime, prior to production of a transformer, the surface insulation resistance of each test sheet was measured according to the method A described in JIS C 2550-4:2019 and was not less than 200 $\Omega \cdot cm^2$, showing no problem with insulation property (interlaminar insulation resistance).

Accordingly, the present inventors assumed that the interlaminar insulation resistance may sometimes deteriorates in the process of producing a transformer. Specifically, it was assumed that the test sheets rub against each other when being processed into a core of a transformer, and in this process, surfaces of the test sheets are damaged so that the coatings partially peel off, resulting in deterioration of interlaminar insulation resistance.

Such a defect hardly occurs in ordinary transformer production. For some reasons, however, grain oriented electrical steel sheets may be processed into a core of a transformer under a severe condition where, for example, the sheets rub against each other with high surface pressure. In this case, the above-described defect is likely to occur.

Accordingly, the present inventors conducted a test (rubbing test) in which test sheets formed of the same grain oriented electrical steel sheet were stacked and rubbed against each other under various conditions, and subsequently the surface insulation resistance thereof was measured. As a result, the resistance value decreased in some test sheets. In other words, the insulation property (interlaminar insulation resistance) was insufficient in some cases.

The present inventors have made a further study. As a result, it was found that, based on the interlaminar current value of a grain oriented electrical steel sheet having undergone a particular rubbing test, it is possible to determine whether insulation property of the grain oriented electrical steel sheet (insulation property of the grain oriented electrical steel sheet having been processed into a core of a transformer) is good.

Here, the "interlaminar current value" is defined as described below.

That is, in the method A described in JIS C 2550-4:2019, when an average current value of currents carried to all the contact electrodes is expressed by $I_A$, and a total area of all the contact electrodes by A, the interlaminar insulation resistance $R_A$ is expressed by an equation of $R_A=A(1/I_A-1)$, and the $I_A$ is defined as the "interlaminar current value."

The interlaminar insulation resistance $R_A$ is calculated from a reciprocal of the current value $I_A$ and therefore drastically changes even when the current amount slightly varies. Accordingly, the interlaminar current value (current value $I_A$) enables proper evaluation of a minute difference in insulation property (interlaminar insulation resistance $R_A$) of a grain oriented electrical steel sheet.

In the study, specifically, the present inventors first prepared good materials and inferior materials as test sheets of the grain oriented electrical steel sheet to be processed into a core of a transformer.

Both the good materials and the inferior materials before being processed into a core of a transformer had the surface insulation resistance (resistance value) measured according to the method A of JIS C 2550-4:2019 of not less than 200 $\Omega \cdot cm^2$, showing no problem with insulation property (interlaminar insulation resistance).

However, while a transformer produced using the good materials as a core did not have leakage current nor partial discharge, a transformer produced using the inferior materials as a core had leakage current or partial discharge and exhibited insufficient insulation property.

The good materials and the inferior materials were each subjected to the rubbing test under the conditions (surface pressure, rubbing speed, reciprocating stroke, and number of reciprocations) shown in Table 1 below. The rubbing test was repeated 10 times under the respective conditions, and thereafter the interlaminar current value (unit: A) was determined. The average (μ) and the standard deviation (σ) of the ten obtained interlaminar current values are shown in Table 1.

TABLE 1

| | | | | | Good material Interlaminar current value [A] | | | Inferior material Interlaminar current value [A] | | | |
|---|---|---|---|---|---|---|---|---|---|---|---|
| No. | Surface pressure [Pa] | Rubbing speed [m/s] | Reciprocating stroke [mm] | Number of reciprocations [times] | Average (μ) | Standard deviation (σ) | μ + σ | Average (μ) | Standard deviation (σ) | μ − σ | Pass/Fail |
| 1 | 100 | 0.10 | 50 | 90 | 0.02 | 0.01 | 0.03 | 0.04 | 0.02 | 0.02 | Fail |
| 2 | 150 | 0.10 | 50 | 90 | 0.03 | 0.01 | 0.04 | 0.10 | 0.03 | 0.07 | Pass |
| 3 | 200 | 0.10 | 50 | 90 | 0.05 | 0.02 | 0.07 | 0.14 | 0.04 | 0.10 | Pass |
| 4 | 250 | 0.10 | 50 | 90 | 0.09 | 0.03 | 0.12 | 0.17 | 0.04 | 0.13 | Pass |
| 5 | 300 | 0.10 | 50 | 90 | 0.17 | 0.06 | 0.23 | 0.31 | 0.11 | 0.20 | Fail |
| 6 | 200 | 0.02 | 50 | 90 | 0.03 | 0.02 | 0.05 | 0.09 | 0.04 | 0.05 | Fail |
| 7 | 200 | 0.05 | 50 | 90 | 0.04 | 0.02 | 0.06 | 0.11 | 0.04 | 0.07 | Pass |

TABLE 1-continued

| No. | Surface pressure [Pa] | Rubbing speed [m/s] | Reciprocating stroke [mm] | Number of reciprocations [times] | Good material Interlaminar current value [A] Average (μ) | Standard deviation (σ) | μ + σ | Inferior material Interlaminar current value [A] Average (μ) | Standard deviation (σ) | μ − σ | Pass/Fail |
|---|---|---|---|---|---|---|---|---|---|---|---|
| 8 | 200 | 0.10 | 50 | 90 | 0.05 | 0.02 | 0.07 | 0.13 | 0.04 | 0.09 | Pass |
| 9 | 200 | 0.15 | 50 | 90 | 0.06 | 0.02 | 0.08 | 0.16 | 0.07 | 0.09 | Pass |
| 10 | 200 | 0.20 | 50 | 90 | 0.08 | 0.03 | 0.11 | 0.18 | 0.08 | 0.10 | Fail |
| 11 | 200 | 0.10 | 10 | 90 | 0.04 | 0.02 | 0.06 | 0.10 | 0.05 | 0.05 | Fail |
| 12 | 200 | 0.10 | 30 | 90 | 0.04 | 0.02 | 0.06 | 0.12 | 0.05 | 0.07 | Pass |
| 13 | 200 | 0.10 | 50 | 90 | 0.05 | 0.02 | 0.07 | 0.14 | 0.05 | 0.09 | Pass |
| 14 | 200 | 0.10 | 70 | 90 | 0.05 | 0.03 | 0.08 | 0.16 | 0.05 | 0.11 | Pass |
| 15 | 200 | 0.10 | 90 | 90 | 0.07 | 0.03 | 0.10 | 0.16 | 0.06 | 0.10 | Fail |
| 16 | 200 | 0.10 | 50 | 30 | 0.04 | 0.02 | 0.06 | 0.09 | 0.04 | 0.05 | Fail |
| 17 | 200 | 0.10 | 50 | 60 | 0.04 | 0.02 | 0.06 | 0.11 | 0.04 | 0.07 | Pass |
| 18 | 200 | 0.10 | 50 | 90 | 0.05 | 0.02 | 0.07 | 0.14 | 0.05 | 0.09 | Pass |
| 19 | 200 | 0.10 | 50 | 120 | 0.07 | 0.03 | 0.10 | 0.16 | 0.05 | 0.11 | Pass |
| 20 | 200 | 0.10 | 50 | 150 | 0.09 | 0.03 | 0.12 | 0.18 | 0.07 | 0.11 | Fail |

In Table 1 above, attention should be first drawn to the interlaminar current values of Nos. 1 to 5 among which only the surface pressure varies (with other conditions being fixed).

Of these, No. 2 (surface pressure: 150 Pa) showed the μ+σ value (0.04) of the good material failing to reach the μ−σ value (0.07) of the inferior material, and it is obvious that the interlaminar current value is different between the good material and the inferior material. In this case, the space for "Pass/Fail" in Table 1 above was filled with "Pass." The same applies to Nos. 3 to 4.

On the contrary, No. 1 (surface pressure: 100 Pa) showed the μ+σ value (0.03) of the good material reaching the μ−σ value (0.02) of the inferior material, and it is not obvious that the interlaminar current value is different between the good material and the inferior material. In this case, the space for "Pass/Fail" in Table 1 above was filled with "Fail." The same applies to No. 5.

Turning to Nos. 6 to 10 among which only the rubbing speed varies, Nos. 11 to 15 among which only the reciprocating stroke varies, and Nos. 16 to 20 among which only the number of reciprocations varies, the spaces for "Pass/Fail" in Table 1 above were also filled with "Pass" or "Fail" in the same manner.

The results shown in Table 1 above revealed that when the rubbing test is conducted under the specific conditions, it is possible to appropriately determine whether the insulation property is good or not based on the interlaminar current value.

That is, the rubbing test is conducted by stacking two sheets of the same grain oriented electrical steel sheet and rubbing the two sheets against each other to make to 120 reciprocations under the conditions of the surface pressure of 150 to 250 Pa, the rubbing speed of to 0.15 m/s, and the reciprocating stroke of 30 to 70 mm.

The present inventors have made a further study about the rubbing test.

As a result, it was found that when a grain oriented electrical steel sheet having undergone the rubbing test under the conditions of the surface pressure of 200 Pa, the rubbing speed of 0.10 m/s, the reciprocating stroke of 50 mm, and the number of reciprocations of 90 has the interlaminar current value after the rubbing test of not more than 0.10 A, the insulation property is good. Specifically, it was found that even when the grain oriented electrical steel sheet is processed into a core of a transformer, leakage current or partial discharge does not occur in the transformer.

In a case where a grain oriented electrical steel sheet is subjected to the rubbing test before being used to produce a transformer and showed a sufficiently low interlaminar current value, a transformer can be produced without any special care.

[Grain Oriented Electrical Steel Sheet]

Next, the grain oriented electrical steel sheet of the invention is described.

The grain oriented electrical steel sheet of the invention comprises a steel sheet and a coating provided on each of both surfaces of the steel sheet, and has the interlaminar current value after the rubbing test of not more than 0.10 A. Meanwhile, the rubbing test is conducted by stacking two sheets of the grain oriented electrical steel sheet and rubbing the two sheets against each other to make 90 reciprocations under the conditions of the surface pressure of 200 Pa, the rubbing speed of 0.10 m/s, and the reciprocating stroke of 50 mm.

As described above, when the grain oriented electrical steel sheet of the invention as described above is processed into a core of a transformer, leakage current or partial discharge does not occur in the transformer, and the insulation property is good.

Because the insulation property is more excellent, the interlaminar current value is preferably not more than 0.08 A, more preferably not more than 0.05 A, and further preferably not more than 0.03 A.

Since the insulation property is excellent when no interlaminar current is passed, the lower limit of the interlaminar current value is not particularly limited.

<Coating>

An example of the coating is a so-called insulating coating formed using a coating liquid described later. In this case, the composition of the coating follows the composition of the coating liquid described later.

<<Hardness>>

When the coating is too hard, hard powder may be generated during the rubbing test and work as an abrasive to damage the coating, whereby the interlaminar current value tends to become large.

Hence, the hardness of the coating is preferably not more than 9.0 GPa, more preferably not more than 8.5 GPa, further preferably not more than 8.0 GPa, and particularly preferably not more than 7.5 GPa. With the hardness falling within this range, the interlaminar current value after the rubbing test becomes smaller, and the insulation property (laminar insulation resistance) is more excellent.

Meanwhile, the lower limit of the hardness of the coating is not particularly limited and is, for example, not less than 5.0 GPa.

If the coating is too soft, however, the tension the coating applies to the steel sheet decreases, and the iron loss may be increased. Accordingly, for the sake of iron loss reduction, the hardness of the coating is preferably not less than 6.0 GPa and more preferably not less than 6.5 GPa.

The hardness of the coating is determined through the nanoindentation method using a triangular pyramid indenter made of diamond (Berkovich-type, apex angle: 60°).

The nanoindentation method is a method in which an indenter is pressed into an object, a load and a depth are continuously measured, and a composite elasticity is determined based on the relationship between the pressing depth and load.

More specifically, an indenter is pressed into a coating of a grain oriented electrical steel sheet under the conditions of the load time of 5 seconds, the unloading time of 2 seconds, and the maximum load of 1,000 μN, and the hardness is measured at room temperature in a linear load application mode. An average value of measurement values taken at three arbitrary locations is regarded as the hardness of the coating.

<<Surface Roughness>>

When the coating has too rough a surface, the coatings facing each other may be damaged in the rubbing test, whereby the interlaminar current value tends to become large.

Accordingly, the surface roughness of the coating has a maximum peak height Sp of preferably not more than 6.0 μm, more preferably not more than 5.8 μm, and further preferably not more than 5.5 μm. When the coating has a maximum peak height Sp falling within this range, the interlaminar current value after the rubbing test becomes smaller, and the insulation property (interlaminar insulation resistance) is more excellent.

The lower limit of the maximum peak height Sp of the coating is not particularly limited. Meanwhile, when the coating has too small a maximum peak height Sp, it may be difficult to stack the grain oriented electrical steel sheets to be processed into a core of a transformer. Thus, the coating has a maximum peak height Sp of preferably not less than 1.0 μm.

The maximum peak height Sp of the coating is an average value of measurement values taken at three arbitrary locations using a three dimensional roughness measuring instrument (SURFCOM 1500SD2-2 manufactured by TOKYO SEIMITSU CO., LTD., stylus: Rtip 2 μm, (60° conical diamond), measuring speed: 0.6 mm/s, measuring area: 10 mm×10 mm) according to ISO 25178.

<Steel Sheet>

An example of the steel sheet is a steel sheet (grain oriented electrical steel sheet) having undergone finishing annealing that is produced as described below.

First, a steel material is subjected to hot rolling by a known method to thereby obtain a hot rolled steel sheet. The obtained hot rolled steel sheet is subjected to hot band annealing and cold rolling once or plural times, whereby a cold rolled steel sheet with a final thickness is obtained. The obtained cold rolled steel sheet is subjected to primary recrystallization annealing, followed by application of an annealing separator, and finishing annealing is performed. As necessary, the steel sheet is washed with water or slightly pickled to remove unreacted part of the annealing separator.

When an annealing separator comprising MgO is used, a coating containing forsterite (forsterite coating) is formed on a surface of the resulting steel sheet. In this case, a coating such as the insulating coating described above is to be provided on the forsterite coating.

The forsterite coating may not be formed or may be removed by pickling or other treatment after being formed. In this case, a coating such as the insulating coating as described above is to be directly provided on a surface of the steel sheet. In order for the insulating coating to be securely adhered, for example, an undercoating such as a ceramic coating different from the forsterite coating may be provided under the insulation coating.

<<Steel Composition>>

The steel sheet preferably has a steel composition containing, by mass, Si: 2.0 to 4.0% and Mn: 0.03 to 0.25%, with the balance being Fe and inevitable impurities.

Si is an element serving to increase the specific resistance of steel and reduce the iron loss. Hence, the Si content is preferably not less than 2.0 mass %, and more preferably not less than 2.8 mass %.

On the other hand, an excessive amount of Si may lower the processability, resulting in difficulty in the production with rolling. Hence, the Si content is preferably not more than 4.0 mass %, and more preferably not more than 3.7 mass %.

Mn is an element serving to improve the hot working property of steel. Hence, the Mn content is preferably not less than 0.03 mass %, and more preferably not less than 0.04 mass %.

On the other hand, an excessive amount of Mn may lower the magnetic flux density of the resulting grain oriented electrical steel sheet. Hence, the Mn content is preferably not more than 0.25 mass %, and more preferably not more than 0.20 mass %.

For the improved magnetic properties, the steel composition may further contain at least one selected from the group consisting of, by mass, Ni: not more than 1.50%, Cr: not more than 0.50%, Cu: not more than 0.50%, P: not more than 0.100%, Sb: not more than 0.500%, Sn: not more than 0.500%, Bi: not more than 0.100%, Mo: not more than 0.100%, Nb: not more than 0.0100%, V: not more than 0.010%, Ti: not more than 0.010%, and Ta: not more than 0.010%.

In a case where Ni is contained, to achieve an effect of addition thereof, the Ni content is preferably not less than 0.01 mass %, and more preferably not less than 0.05 mass %. In this case, on the other hand, the Ni content is not more than 1.50 mass %, preferably not more than 1.00 mass %, and more preferably not more than 0.50 mass %.

In a case where Cr is contained, to achieve an effect of addition thereof, the Cr content is preferably not less than 0.01 mass %, and more preferably not less than 0.03 mass %. In this case, on the other hand, the Cr content is not more than 0.50 mass %, preferably not more than 0.35 mass %, and more preferably not more than 0.20 mass %.

In a case where Cu is contained, to achieve an effect of addition thereof, the Cu content is preferably not less than 0.01 mass %, and more preferably not less than 0.02 mass %. In this case, on the other hand, the Cu content is not more than 0.50 mass %, preferably not more than 0.35 mass %, and more preferably not more than 0.20 mass %.

In a case where P is contained, to achieve an effect of addition thereof, the P content is preferably not less than 0.005 mass %, and more preferably not less than 0.010 mass %. In this case, on the other hand, the P content is not more than 0.100 mass %, preferably not more than 0.080 mass %, and more preferably not more than 0.060 mass %.

In a case where Sb is contained, to achieve an effect of addition thereof, the Sb content is not less than 0.005 mass %, and more preferably not less than 0.010 mass %. In this case, on the other hand, the Sb content is not more than 0.500 mass %, preferably not more than 0.350 mass %, and more preferably not more than 0.200 mass %.

In a case where Sn is contained, to achieve an effect of addition thereof, the Sn content is preferably not less than 0.005 mass %, and more preferably not less than 0.010 mass %. In this case, on the other hand, the Sn content is not more than 0.500 mass %, preferably not more than 0.350 mass %, and more preferably not more than 0.200 mass %.

In a case where Bi is contained, to achieve an effect of addition thereof, the Bi content is preferably not less than 0.001 mass %, and more preferably not less than 0.002 mass %. In this case, on the other hand, the Bi content is not more than 0.100 mass %, preferably not more than 0.050 mass %, and more preferably not more than 0.010 mass %.

In a case where Mo is contained, to achieve an effect of addition thereof, the Mo content is preferably not less than 0.005 mass %, and more preferably not less than 0.008 mass %. In this case, on the other hand, the Mo content is not more than 0.100 mass %, preferably not more than 0.085 mass %, and more preferably not more than 0.070 mass %.

In a case where Nb is contained, to achieve an effect of addition thereof, the Nb content is preferably not less than 0.0010 mass %, and more preferably not less than 0.0020 mass %. In this case, on the other hand, the Nb content is not more than 0.0100 mass %, preferably not more than 0.0080 mass %, and more preferably not more than 0.0050 mass %.

In a case where V is contained, to achieve an effect of addition thereof, the V content is preferably not less than 0.001 mass %, and more preferably not less than 0.002 mass %. In this case, on the other hand, the V content is not more than 0.010 mass %, and preferably not more than mass %.

In a case where Ti is contained, to achieve an effect of addition thereof, the Ti content is preferably not less than 0.001 mass %, and more preferably not less than 0.002 mass %. In this case, on the other hand, the Ti content is not more than 0.010 mass %, and preferably not more than mass %.

In a case where Ta is contained, to achieve an effect of addition thereof, the Ta content is preferably not less than 0.001 mass %, and more preferably not less than 0.002 mass %. In this case, on the other hand, the Ta content is not more than 0.010 mass %, and preferably not more than mass %.

[Method of Producing Grain Oriented Electrical Steel Sheet]

Next, described is a method of producing the foregoing grain oriented electrical steel sheet of the invention (hereinafter, also referred to as "production method of the invention" for convenience).

The production method of the invention is generally a method in which a coating is formed on each of both surfaces of the above-described steel sheet while the steel sheet is transported using a transport roll.

In the production method of the invention, while being transported, the steel sheet is subjected to application of a coating liquid, baking at a temperature of not lower than 700° C., and cooling, whereby the coating as described above is formed.

<Coating Liquid>

Components that may be contained in the coating liquid used in the production method of the invention are first described.

<<Phosphoric Acid Component P and Silica S>>

The coating liquid contains, for example, phosphoric acid component P and silica S.

Examples of the phosphoric acid component P include a phosphoric acid and a phosphate. The phosphate is exemplified by a phosphate (metallic phosphate) containing a metal element such as metal element M1 or metal element 2 to be described later, and a primary phosphate is preferred from the viewpoint of availability.

The silica S is exemplified by colloidal silica. The average particle diameter of the colloidal silica is not particularly limited and is, for example, 1 to 100 nm, and preferably 5 to 50 nm.

<<Metal Element M1>>

The coating liquid contains, for instance, at least one metal element M1 selected from the group consisting of Zn, Li, Mg, and Ca.

The metal element M1 lowers the hardness of the coating formed using the coating liquid containing the metal element M1. Because the coating contains a suitable amount of the metal element M1, the interlaminar current value after the rubbing test becomes small.

The metal element M1 is contained in the coating liquid in the form of, for instance, a metal species (cation) of the phosphoric acid component P being a phosphate. In addition, the metal element M1 contained in the coating liquid may take various forms of compound including oxide, hydroxide, sulfate, nitrate, and carbonate.

<<Metal Element M2>>

The coating liquid contains, for instance, at least one metal element M2 selected from the group consisting of Zr, Ti, Cr, and Al.

The metal element M2 increases the Young's modulus of the coating formed using the coating liquid containing the metal element M2. Because the metal element M1 lowers the hardness of the coating as described above, the tension the coating applies to the steel sheet may be decreased. In such a case, the tension can be prevented from decreasing by using the metal element M2 in combination.

The metal element M2 is contained in the coating liquid in the form of, for instance, a metal species (cation) of the phosphoric acid component P being a phosphate. In addition, the metal element M2 contained in the coating liquid may take various forms of compound including oxide, hydroxide, sulfate, nitrate, and carbonate.

Next, described are the contents of the foregoing components in the coating liquid.

<<Molar Ratio M1/S>>

As described above, the metal element M1 lowers the hardness of the coating.

In the coating liquid, the molar ratio M1/S of the metal element M1 content to the silica S content in terms of $SiO_2$ is not less than 0.15. With this constitution, the coating to be formed is prevented from becoming too hard, and the interlaminar current value after the rubbing test becomes small.

Because this effect becomes more excellent, the molar ratio M1/S is preferably not less than 0.20, and more preferably not less than 0.25.

On the other hand, the upper limit of the molar ratio M1/S is not particularly limited and is, for example, not more than 0.40.

Meanwhile, for the sake of reducing the iron loss, the molar ratio M1/S is preferably not more than 0.35, and more preferably not more than 0.30. With the molar ratio M1/S falling within this range, the coating liquid is stable and excellent in coatability, and the coating is uniformly formed.

As a result, tension is stably applied to the steel sheet, thereby achieving an excellent effect of reducing the iron loss.

<<Molar Ratio M2/S>>

In the coating liquid, the molar ratio M2/S of the metal element M2 content to the silica S content in terms of $SiO_2$ is not more than 0.15. With this constitution, a surface of the coating to be formed is prevented from becoming too rough, and the interlaminar current value after the rubbing test becomes small.

Because this effect becomes more excellent, the molar ratio M2/S is preferably not more than 0.10, and more preferably not more than 0.08.

On the other hand, the lower limit of the molar ratio M2/S is not particularly limited and is, for example, not less than 0.01.

Meanwhile, for the sake of reducing the iron loss, the molar ratio M2/S is preferably not less than 0.02, and more preferably not less than 0.05. As described above, the metal element M2 increases the Young's modulus of the coating. With the molar ratio M2/S falling within this range, the Young's modulus of the coating is increased, and tension is stably applied to the steel sheet, thereby achieving an excellent effect of reducing the iron loss.

<<Molar Ratio P/S>>

In the coating liquid, the molar ratio P/S of the phosphoric acid component P content in terms of $P_2O_5$ to the silica S content in terms of $SiO_2$ is not less than 0.20. With this constitution, the coating to be formed is prevented from becoming too hard, and the interlaminar current value after the rubbing test becomes small. In addition, this constitution improves coating formability, and generation of cracks in the coating is prevented, resulting in excellent corrosion resistance.

Because this effect becomes more excellent, the molar ratio P/S is preferably not less than 0.23, and preferably not less than 0.25.

On the other hand, the upper limit of the molar ratio P/S is not particularly limited and is, for example, not more than 0.50.

Meanwhile, for the sake of reducing the iron loss, the molar ratio P/S is preferably not more than 0.40, and more preferably not more than 0.35. With the molar ratio P/S falling within this range, the coating to be formed stably applies tension to the steel sheet, thereby achieving an excellent effect of reducing the iron loss.

<<Other Components>>

The coating liquid may further contain inorganic mineral particles of, for example, $SiO_2$ (excluding the silica S described above), $TiO_2$, and $Al_2O_3$ for the sake of improving heat resistance of the coating.

In the coating liquid, the molar ratio (inorganic mineral particle/S) of the inorganic mineral particle content to the silica S content in terms of $SiO_2$ is not less than 0.001 because the heat resistance effect is more excellent. On the other hand, this molar ratio is preferably not more than 0.050 for the sake of increasing the lamination factor.

The coating liquid may further contain a borate for the sake of improving heat resistance of the coating.

In the coating liquid, the molar ratio (borate/S) of the borate content in terms of $B_2O_3$ to the silica S content in terms of $SiO_2$ is not less than 0.002 because the heat resistance effect is more excellent. On the other hand, this molar ratio is preferably not more than 0.070 for the sake of preventing cracks in the coating and improving corrosion resistance.

<Application>

The coating liquid described above is applied over a surface of the steel sheet (a surface of a forsterite coating in a case where the forsterite coating is formed). The application method is not particularly limited, and a conventional method can be adopted.

After the coating liquid is applied to the steel sheet, drying is optionally performed prior to baking.

The drying temperature is preferably not lower than 150° C., and more preferably not lower than 200° C. On the other hand, the temperature is preferably not higher than 500° C., and more preferably not higher than 400° C.

The drying time (retention time at a temperature of not lower than 150° C.) is preferably not less than 5 seconds and more preferably not less than 10 seconds. On the other hand, the drying time is preferably not more than 120 seconds and more preferably not more than 100 seconds.

<Baking>

Baking doubles as flattening annealing. The baking atmosphere is not particularly limited, and use may be made of, for example, a non-oxidizing atmosphere such as nitrogen atmosphere, an oxidizing atmosphere containing water vapor, a reducing atmosphere such as an atmosphere containing hydrogen, and an atmosphere of mixture thereof.

The baking temperature is not lower than 700° C., and preferably not lower than 720° C. Within this temperature range, sufficient film formation is achieved, whereby the obtained coating is excellent in corrosion resistance, and the tension applied to the steel sheet is sufficient.

Meanwhile, when the baking temperature is too high, the steel sheet may experience creep deformation due to heat, resulting in the increased iron loss. Therefore, from the viewpoint of reducing the iron loss, the baking temperature is preferably not higher than 900° C., and more preferably not higher than 880° C.

The baking time is not particularly limited and is, for example, not less than 5 seconds, and preferably not less than 10 seconds.

Meanwhile, when the baking time is too long, again, the steel sheet may experience creep deformation, resulting in the increased iron loss. Therefore, from the viewpoint of reducing the iron loss, the baking time is preferably not more than 120 seconds, more preferably not more than 90 seconds, and further preferably not more than 60 seconds.

<Cooling>

The steel sheet having undergone baking is cooled from the baking temperature to, for example, room temperature while being transported by a transport roll.

Since the baking temperature is not lower than 700° C., the steel sheet having undergone baking is cooled to a temperature of at least not higher than 600° C. in the process of cooling to room temperature.

<<Forward Slip r>>

Forward slip r (unit: %) is a percentage of a ratio of an absolute value of a difference between a transport speed X of the steel sheet and a circumferential speed Y of a transport roll (=radius×angular velocity) with respect to the circumferential speed Y of the transport roll and is expressed by the following equation.

$$r=\{|X-Y|/Y\}\times 100$$

The larger the forward slip r is, the larger the friction between the steel sheet and the transport roll is.

In a transport region in which the steel sheet having undergone baking is cooled to a temperature of not higher than 600° C. (hereinafter, also called "cooling transport region" for convenience), a coating liquid component (coating component) is solidified, whereby the coating is formed. In this process, if the forward slip r is too large, the formed coating is scratched to have protrusions and is likely to be roughened. In other words, the interlaminar current value after the rubbing test tends to become large.

Hence, the forward slip r in the cooling transport region is not more than 1.7%. With this constitution, the formed coating is not excessively roughened, and the interlaminar current value after the rubbing test becomes small.

Because this effect is more excellent, the forward slip r in the cooling transport region is preferably not more than 1.4%, more preferably not more than 1.0%, and further preferably not more than 0.6%.

While the lower limit of the forward slip r in the cooling transport region is not particularly limited, an excessively low forward slip tends to cause a production trouble such as meandering of the steel sheet or formation of steps when the steel sheet is coiled.

Hence, from the viewpoint of preventing the steel sheet from meandering to ensure good productivity, the forward slip r in the cooling transport region is preferably more than 0.1%, more preferably not less than 0.12%, and further preferably not less than 0.2%.

EXAMPLES

The present invention is specifically described below with reference to examples. However, the invention is not limited to the examples described below.

Example A

<Production of Grain Oriented Electrical Steel Sheet>

According to the production method of the invention as described above, a coating was formed while a steel sheet was transported, and a grain oriented electrical steel sheet was produced (as comparative examples in some cases).

For the steel sheet on which the coating would be formed, a grain oriented silicon steel having undergone finish annealing (magnetic flux density B: 1.91 T, iron loss $W_{17/50}$: 0.75 W/kg) was prepared.

A coating liquid containing colloidal silica ($SiO_2$), monocalcium phosphate ($Ca(H_2PO_4)_2$, phosphoric acid ($H_3PO_4$), and zirconia sol ($ZrO_2$) was applied to each of both surfaces of the prepared steel sheet in an amount which would result in 5 g/m$^2$ per surface after drying. Contents of the respective components in the coating liquid were changed such that the molar ratios (M1/S, M2/S, and P/S) were changed as shown in Table 2 below.

After application of the liquid, the steel sheet was dried (250° C., 50 seconds), followed by baking at 850° C. for 10 seconds in a dry nitrogen atmosphere, the baking also serving as flattening annealing, then cooled to room temperature, and coiled into a coil form. The forward slip r in the transport region (cooling transport region) in which the steel sheet was cooled to a temperature of not higher than 600° C. was changed as shown in Table 2 below. Thus, the grain oriented electrical steel sheet was obtained.

<Hardness, Maximum Peak Height Sp, and Interlaminar Current Value>

Of the grain oriented electrical steel sheet thus obtained, the hardness and the maximum peak height Sp of the coating were measured according to the foregoing methods. The results are shown in Table 2 below.

In addition, the obtained grain oriented electrical steel sheet was subjected to the rubbing test under the conditions of the surface pressure of 200 Pa, the rubbing speed of 0.10 m/s, the reciprocating stroke of 50 mm, and the number of reciprocations of 90, and the interlaminar current value after the rubbing test was measured. The results are shown in Table 2 below.

<Insulation Property>

The obtained grain oriented electrical steel sheet was processed into a core, and a transformer was prepared.

Specifically, the transformer was prepared in accordance with the method described in paragraph in WO2018/181831. The prepared transformer was subjected to the withstand voltage test described in the sections 9.9.1 to 9.9.4 in JIS C 4304:2013 to find whether current leakage and partial discharge occurred.

In Table 2 below, for the examples where no occurrence of current leakage or partial discharge was confirmed in every test, "good" was shown, while for the examples where occurrence of current leakage or partial discharge was confirmed in any of the tests, "fail" was shown. Grain oriented electrical steel sheets of the examples to which "good" is given can be rated as exhibiting excellent insulation property (interlaminar insulation resistance) even when used for a practical transformer.

<Iron Loss $W_{17/50}$>

The iron loss $W_{17/50}$ of the obtained grain oriented electrical steel sheet was determined according to JIS C 2556: 2015. The results are shown in Table 2 below.

TABLE 2

| | Molar ratio M1/S | Molar ratio M2/S | Molar ratio P/S | Forward slip r [%] | Hardness [GPa] | Maximum peak height Sp [μm] | Interlaminar current value [A] | Insulation property | Iron loss $W_{17/50}$ [W/kg] |
|---|---|---|---|---|---|---|---|---|---|
| A1 | 0.10 | 0.06 | 0.25 | 0.6 | 9.4 | 4.8 | 0.15 | Fai | 0.72 |
| A2 | 0.15 | 0.06 | 0.25 | 0.6 | 8.5 | 4.3 | 0.08 | Good | 0.72 |
| A3 | 0.20 | 0.06 | 0.25 | 0.6 | 7.8 | 4.4 | 0.04 | Good | 0.72 |
| A4 | 0.25 | 0.06 | 0.25 | 0.6 | 7.2 | 4.7 | 0.03 | Good | 0.72 |
| A5 | 0.30 | 0.06 | 0.25 | 0.6 | 6.9 | 5.2 | 0.03 | Good | 0.73 |
| A6 | 0.35 | 0.06 | 0.25 | 0.6 | 6.6 | 5.2 | 0.01 | Good | 0.73 |
| A7 | 0.40 | 0.06 | 0.25 | 0.6 | 5.8 | 5.8 | 0.01 | Good | 0.75 |
| A8 | 0.25 | 0.01 | 0.25 | 1.4 | 6.9 | 4.4 | 0.01 | Good | 0.75 |
| A9 | 0.25 | 0.02 | 0.25 | 1.4 | 6.9 | 4.7 | 0.01 | Good | 0.73 |
| A10 | 0.25 | 0.04 | 0.25 | 1.4 | 7.0 | 3.5 | 0.03 | Good | 0.72 |
| A11 | 0.25 | 0.10 | 0.25 | 1.4 | 7.0 | 4.2 | 0.03 | Good | 0.71 |
| A12 | 0.25 | 0.15 | 0.25 | 1.4 | 7.1 | 5.6 | 0.06 | Good | 0.71 |
| A13 | 0.25 | 0.18 | 0.25 | 1.4 | 7.3 | 6.1 | 0.11 | Fail | 0.71 |
| A14 | 0.25 | 0.20 | 0.25 | 1.4 | 7.5 | 6.7 | 0.11 | Fail | 0.71 |
| A15 | 0.25 | 0.06 | 0.10 | 1.4 | 9.6 | 5.7 | 0.12 | Fail | 0.73 |

TABLE 2-continued

| | Molar ratio M1/S | Molar ratio M2/S | Molar ratio P/S | Forward slip r [%] | Hardness [GPa] | Maximum peak height Sp [μm] | Interlaminar current value [A] | Insulation property | Iron loss $W_{17/50}$ [W/kg] |
|---|---|---|---|---|---|---|---|---|---|
| A16 | 0.25 | 0.06 | 0.15 | 1.4 | 9.2 | 5.1 | 0.11 | Fail | 0.73 |
| A17 | 0.25 | 0.06 | 0.20 | 1.4 | 7.3 | 4.4 | 0.07 | Good | 0.73 |
| A18 | 0.25 | 0.06 | 0.24 | 1.4 | 7.2 | 3.6 | 0.03 | Good | 0.73 |
| A19 | 0.25 | 0.06 | 0.40 | 1.4 | 7.2 | 3.8 | 0.02 | Good | 0.73 |
| A20 | 0.25 | 0.06 | 0.45 | 1.4 | 7.0 | 4.8 | 0.01 | Good | 0.75 |
| A21 | 0.25 | 0.06 | 0.50 | 1.4 | 6.9 | 4.2 | 0.01 | Good | 0.75 |
| A22 | 0.25 | 0.06 | 0.25 | 0.1 | — | — | — | — | — |
| A23 | 0.25 | 0.06 | 0.25 | 0.2 | 7.1 | 4.2 | 0.01 | Good | 0.73 |
| A24 | 0.25 | 0.06 | 0.25 | 0.5 | 7.2 | 4.6 | 0.02 | Good | 0.73 |
| A25 | 0.25 | 0.06 | 0.25 | 1.0 | 7.2 | 5.1 | 0.05 | Good | 0.73 |
| A26 | 0.25 | 0.06 | 0.25 | 1.7 | 7.3 | 5.8 | 0.09 | Good | 0.73 |
| A27 | 0.25 | 0.06 | 0.25 | 2.0 | 7.4 | 6.2 | 0.11 | Fail | 0.73 |
| A28 | 0.25 | 0.06 | 0.25 | 2.5 | 7.4 | 6.5 | 0.16 | Fail | 0.73 |
| A29 | 0.10 | 0.06 | 0.25 | 2.2 | 9.8 | 7.8 | 0.29 | Fail | 0.73 |
| A30 | 0.15 | 0.06 | 0.25 | 2.2 | 8.8 | 7.1 | 0.26 | Fail | 0.73 |
| A31 | 0.20 | 0.06 | 0.25 | 2.2 | 8.3 | 6.7 | 0.19 | Fail | 0.73 |
| A32 | 0.25 | 0.06 | 0.25 | 2.2 | 7.5 | 6.5 | 0.13 | Fail | 0.73 |
| A33 | 0.30 | 0.06 | 0.25 | 2.2 | 6.9 | 6.4 | 0.12 | Fail | 0.73 |
| A34 | 0.35 | 0.06 | 0.25 | 2.2 | 6.6 | 6.1 | 0.12 | Fail | 0.73 |
| A35 | 0.40 | 0.06 | 0.25 | 2.2 | 5.9 | 6.1 | 0.11 | Fail | 0.75 |

Summary of Evaluation Results

Example A1 to Example A7

Among Example A1 to Example A7, Example A1 where the molar ratio M1/S was less than 0.15 showed the hardness of the coating of more than 9.0 GPa and the interlaminar current value after the rubbing test of more than 0.10 A, exhibiting insufficient insulation property.

On the contrary, Example A2 to Example A7 where the molar ratio M1/S was not less than 0.15 showed the hardness of the coating of not more than 9.0 GPa and the interlaminar current value after the rubbing test of not more than 0.10 A, exhibiting good insulation property.

Among Example A2 to Example 7A, Example A2 to Example A6 where the molar ratio M1/S was not more than 0.35 showed the hardness of the coating of not less than 6.0 GPa and had a smaller iron loss than that in Example A7 where the above-described molar ratio range was not satisfied.

Example A8 to Example A14

Among Example A8 to Example A14, Example A13 and Example A14 where the molar ratio M2/S was more than 0.15 showed the maximum peak height Sp of the coating of more than 6.0 μm and the interlaminar current value after the rubbing test of more than 0.10 A, exhibiting insufficient insulation property.

On the other hand, Example A8 to Example A12 where the molar ratio M2/S was not more than 0.15 showed the maximum peak height Sp of the coating of not more than 6.0 μm and the interlaminar current value after the rubbing test of not more than 0.10 A, exhibiting good insulation property.

Among Example A8 to Example A12, Example A9 to Example A12 where the molar ratio M2/S was not less than had a smaller iron loss than that in Example A8 where the above-described molar ratio range was not satisfied.

Example A15 to Example A21

Among Example A15 to Example A21, Example A15 and Example A16 where the molar ratio P/S was less than 0.20 showed the hardness of the coating of more than 9.0 GPa and the interlaminar current value after the rubbing test of more than 0.10 A, exhibiting insufficient insulation property.

On the other hand, Example A17 to Example A21 where the molar ratio P/S was not less than 0.20 showed the hardness of the coating of not more than 9.0 GPa and the interlaminar current value after the rubbing test of not more than 0.10 A, exhibiting good insulation property.

Among Example A17 to Example A21, Example A17 to Example A19 where the molar ratio P/S was not more than had a smaller iron loss than that in Example A20 and Example A21 where the above-described molar ratio range was not satisfied.

Example A22 to Example A28

Among Example A22 to Example A28, Example A27 and Example A28 where the forward slip r in the cooling transport region was more than 1.7% showed the maximum peak height Sp of the coating of more than 6.0 μm and the interlaminar current value after the rubbing test of more than 0.10 A, exhibiting insufficient insulation property.

On the other hand, Example A23 to Example A26 where the forward slip r in the cooling transport region was not more than 1.7% showed the maximum peak height Sp of the coating of not more than 6.0 μm and the interlaminar current value after the rubbing test of not more than 0.10 A, exhibiting good insulation property.

In Example A22 where the forward slip r in the cooling transport region was 0.1%, the steel sheet meandered, and thus the evaluations were not performed (the relevant spaces in Table 2 above were filled with a symbol "-").

Example A29 to Example A35

Example A29 to Example A35 correspond to Example A1 to A7, respectively, except that the forward slip r in the cooling transport region was changed from 0.6% to 2.2%.

Example A29 to Example A35 where the forward slip r in the cooling transport region was more than 1.7% all showed the maximum peak height Sp of the coating of more than 6.0 μm and the interlaminar current value after the rubbing test of more than 0.10 A, exhibiting insufficient insulation property.

Example B

<Production of Grain Oriented Electrical Steel Sheet>

According to the production method of the invention as described above, a coating was formed while a steel sheet was transported, and a grain oriented electrical steel sheet was produced (as comparative examples in some cases).

For the steel sheet on which the coating would be formed, a steel sheet (grain oriented electrical steel sheet, sheet thickness: 0.23 mm) having undergone finish annealing produced in accordance with an ordinary method was prepared. It should be noted that after finish annealing, unreacted part of the annealing separator was removed, followed by pickling with phosphoric acid.

The coating liquid having the composition shown in Table 3 below was applied to each of both surfaces of the prepared steel sheet in an amount which would result in 10 g/m$^2$ per surface after drying.

As a supply source of the metal element M1, use was made of zinc sulfate ($ZnSO_4$), lithium nitrate ($LiNO_3$), monomagnesium phosphate ($Mg(H_2PO_4)_2$), and monocalcium phosphate ($Ca(H_2PO_4)_2$). For the example where the coating liquid did not contain the metal element M1, a symbol "-" was placed in Table 3 below.

As a supply source of the metal element M2, use was made of titania sol ($TiO_2$), chromic anhydride ($CrO_3$), and monoaluminum phosphate ($Al(H_2PO_4)_3$). For the example where the coating liquid did not contain the metal element M2, a symbol "-" was placed in Table 3 below.

In addition to the foregoing, the coating liquid contained colloidal silica ($SiO_2$), and also, as appropriate, phosphoric acid ($H_3$ $PO_4$).

After application of the liquid, the steel sheet was dried (300° C., 50 seconds), followed by baking at 800° C. for 10 seconds in a dry nitrogen atmosphere, the baking also serving as flattening annealing, and then cooled to room temperature. The forward slip r in the transport region (cooling transport region) in which the steel sheet was cooled to a temperature of not higher than 600° C. was 1.2%. Thus, the grain oriented electrical steel sheet was obtained.

<Hardness, Maximum Peak Height Sp, and Interlaminar Current Value>

Of the grain oriented electrical steel sheet thus obtained, in the same manner as in Example A, the hardness and the maximum peak height Sp of the coating were measured, and further the interlaminar current value after the rubbing test was measured. The results are shown in Table 3 below.

<Insulation Property and Iron Loss $W_{17/50}$>

In the same manner as in Example A, the obtained grain oriented electrical steel sheet was evaluated for insulation property, and, in addition, the iron loss $W_{17/50}$ thereof was measured. The results are shown in Table 3 below.

TABLE 3

| | Metal element M1 | Metal element M2 | Molar ratio M1/S | Molar ratio M2/S | Molar ratio P/S | Forward slip r [%] | Hardness [GPa] | Maximum peak height Sp [μm] | Interlaminar current value [A] | Insulation property | Iron loss $W_{17/50}$ [W/kg] |
|---|---|---|---|---|---|---|---|---|---|---|---|
| B1 | — | Cr | 0.00 | 0.06 | 0.25 | 1.2 | 10.1 | 4.8 | 0.41 | Fail | 0.73 |
| B2 | L | Cr | 0.25 | 0.06 | 0.25 | 1.2 | 7.3 | 4.3 | 0.04 | Good | 0.73 |
| B3 | Mg | Cr | 0.25 | 0.06 | 0.25 | 1.2 | 6.2 | 3.1 | 0.05 | Good | 0.73 |
| B4 | Zn | Cr | 0.25 | 0.06 | 0.25 | 1.2 | 6.8 | 4.5 | 0.06 | Good | 0.73 |
| B5 | Zn/Mg (1/1) | Cr | 0.24 | 0.06 | 0.25 | 1.2 | 6.3 | 3.2 | 0.06 | Good | 0.73 |
| B6 | Ca | — | 0.25 | 0.00 | 0.25 | 1.2 | 5.8 | 5.8 | 0.08 | Good | 0.75 |
| B7 | Ca | Cr | 0.25 | 0.06 | 0.25 | 1.2 | 7.5 | 3.5 | 0.07 | Good | 0.73 |
| B8 | Ca | Al | 0.25 | 0.06 | 0.25 | 1.2 | 8.7 | 4.1 | 0.08 | Good | 0.72 |
| B9 | Mg | Ti | 0.25 | 0.06 | 0.25 | 1.2 | 8.1 | 4.6 | 0.07 | Good | 0.72 |
| B10 | Mg | Al/Ti (1/1) | 0.25 | 0.06 | 0.25 | 1.2 | 8.4 | 4.4 | 0.08 | Good | 0.72 |

Summary of Evaluation Results

Example B1 to Example B5

Among Example B1 to Example B5, Example B1 where the molar ratio M1/S was less than 0.15 showed the hardness of the coating of more than 9.0 GPa and the interlaminar current value after the rubbing test of more than 0.10 A, exhibiting insufficient insulation property.

On the other hand, Example B2 to Example B5 where the molar ratio M1/S was not less than 0.15 showed the hardness of the coating of not more than 9.0 GPa and the interlaminar current value after the rubbing test of not more than 0.10 A, exhibiting good insulation property.

Example B6 to Example B10

Example B6 to Example B10 where the molar ratio M2/S was not more than 0.15 showed the maximum peak height Sp of the coating of not more than 6.0 μm and the interlaminar current value after the rubbing test of not more than 0.10 A, exhibiting good insulation property.

Among those, Example B7 to Example B10 where the molar ratio M2/S was not less than 0.02 had a smaller iron loss than that in Example B6 where the above-described ratio range was not satisfied.

Example C

<Production of Grain Oriented Electrical Steel Sheet>

According to the production method of the invention as described above, a coating was formed while a steel sheet was transported, and a grain oriented electrical steel sheet was produced (as comparative examples in some cases).

For the steel sheet on which the coating would be formed, various types of steel sheets (grain oriented electrical steel sheets) having undergone finish annealing were prepared. It should be noted that after finish annealing, unreacted part of the annealing separator was removed, followed by pickling with phosphoric acid. Compositions of the respective steel sheets are shown in Table 4 below. In Table 4 below, "Tr" indicates that an amount of the relevant component was less than the quantitation limit.

The same coating liquid as that in Example A1 or Example A5 (see Table 2) was applied to each of both surfaces of the prepared steel sheet in an amount which would result in 15 g/m$^2$ per surface after drying.

Thereafter, drying, baking, and cooling were performed under the same conditions as in Example A. The forward slip r in the cooling transport region was 0.6%. Thus, the grain oriented electrical steel sheet was obtained.

<Hardness, Maximum Peak Height Sp, and Interlaminar Current Value>

Of the grain oriented electrical steel sheet thus obtained, in the same manner as in Example A, the hardness and the maximum peak height Sp of the coating were measured, and further the interlaminar current value after the rubbing test was measured. The results are shown in Table 4 below.

<Insulation Property and Iron Loss $W_{17/50}$>

In the same manner as in Example A, the obtained grain oriented electrical steel sheet was evaluated for insulation property, and, in addition, the iron loss $W_{717/50}$ thereof was measured. The results are shown in Table 4 below.

TABLE 4

| | Composition [mass %] | | | | | | | | | | |
|---|---|---|---|---|---|---|---|---|---|---|---|
| | Si | Mn | Ni | Cr | Cu | P | Sb | Sn | Bi | Mo | Nb |
| C1 | 2.8 | 0.05 | Tr | Tr | Tr | Tr | Tr | Tr | Tr | Tr | Tr |
| C2 | 3.2 | 0.06 | 0.01 | Tr | Tr | Tr | 0.005 | Tr | Tr | Tr | Tr |
| C3 | 3.6 | 0.06 | 0.10 | Tr | Tr | Tr | Tr | 0.005 | Tr | Tr | Tr |
| C4 | 3.3 | 0.15 | 0.40 | Tr | Tr | Tr | Tr | Tr | 0.001 | Tr | Tr |
| C5 | 3.4 | 0.23 | Tr | 0.01 | Tr | Tr | Tr | Tr | Tr | 0.010 | Tr |
| C6 | 3.3 | 0.06 | Tr | 0.05 | Tr | Tr | Tr | Tr | Tr | Tr | 0.0010 |
| C7 | 3.2 | 0.06 | Tr | Tr | 0.02 | Tr | 0.050 | Tr | Tr | Tr | Tr |
| C8 | 3.4 | 0.07 | Tr | Tr | 0.10 | Tr | Tr | 0.150 | Tr | Tr | 0.0030 |
| C9 | 3.3 | 0.07 | Tr | Tr | Tr | 0.005 | Tr | Tr | 0.002 | Tr | Tr |
| C10 | 3.3 | 0.06 | Tr | Tr | Tr | 0.050 | Tr | Tr | Tr | 0.050 | Tr |
| C11 | 2.8 | 0.05 | Tr | Tr | Tr | Tr | Tr | Tr | Tr | Tr | Tr |
| C12 | 3.2 | 0.06 | 0.01 | Tr | Tr | Tr | 0.005 | Tr | Tr | Tr | Tr |

| | Composition [mass %] | | | Examples in Table | Molar ratio | Forward slip | Hardness | Maximum peak height | Inter-laminar current | Insulation | Iron loss $W_{17/50}$ |
|---|---|---|---|---|---|---|---|---|---|---|---|
| | V | Ti | Ta | 2 | M1/S | r [%] | [GPa] | Sp [μm] | value [A] | property | [W/kg] |
| C1 | Tr | Tr | Tr | A5 | 0.30 | 0.6 | 6.5 | 3.2 | 0.05 | Good | 0.84 |
| C2 | Tr | Tr | Tr | A5 | 0.30 | 0.6 | 6.3 | 3.1 | 0.06 | Good | 0.79 |
| C3 | Tr | Tr | Tr | A5 | 0.30 | 0.6 | 6.2 | 3.2 | 0.06 | Good | 0.76 |
| C4 | Tr | Tr | Tr | A5 | 0.30 | 0.6 | 6.5 | 3.1 | 0.06 | Good | 0.77 |
| C5 | Tr | Tr | Tr | A5 | 0.30 | 0.6 | 6.4 | 3.3 | 0.06 | Good | 0.73 |
| C6 | 0.001 | 0.001 | 0.002 | A5 | 0.30 | 0.6 | 6.4 | 3.2 | 0.06 | Good | 0.77 |
| C7 | Tr | Tr | Tr | A5 | 0.30 | 0.6 | 6.5 | 3.3 | 0.06 | Good | 0.75 |
| C8 | 0.010 | 0.002 | 0.003 | A5 | 0.30 | 0.6 | 6.4 | 3.3 | 0.05 | Good | 0.74 |
| C9 | Tr | Tr | Tr | A5 | 0.30 | 0.6 | 6.3 | 3.2 | 0.06 | Good | 0.81 |
| C10 | Tr | Tr | Tr | A5 | 0.30 | 0.6 | 6.3 | 3.3 | 0.06 | Good | 0.72 |
| C11 | Tr | Tr | Tr | A1 | 0.10 | 0.6 | 9.8 | 6.1 | 0.16 | Fail | 0.82 |
| C12 | Tr | Tr | Tr | A1 | 0.10 | 0.6 | 9.8 | 6.3 | 0.15 | Fail | 0.77 |

Summary of Evaluation Results

Example C1 to Example C12

Among Example C1 to Example C12, Example C11 and Example C12 where the molar ratio M1/S was less than 0.15 showed the hardness of the coating of more than 9.0 GPa and the interlaminar current value after the rubbing test of more than 0.10 A, exhibiting insufficient insulation property.

On the other hand, Example C1 to Example C10 where the molar ratio M1/S was not less than 0.15 showed the hardness of the coating of not more than 9.0 GPa and the interlaminar current value after the rubbing test of not higher than 0.10 A, exhibiting good insulation property.

The invention claimed is:

1. A grain oriented electrical steel sheet comprising: a steel sheet; and a coating disposed on each of both surfaces of the steel sheet, wherein an interlaminar current value after a rubbing test is not more than 0.10 A, the rubbing test being conducted by stacking two sheets of the grain oriented electrical steel sheet and rubbing the two sheets against each other to make 90 reciprocations under conditions of a surface pressure of 200 Pa, a rubbing speed of 0.10 m/s, and a reciprocating stroke of 50 mm.

2. The grain oriented electrical steel sheet according to claim 1, wherein the coating has hardness of not more than 9.0 GPa.

3. The grain oriented electrical steel sheet according to claim 2, wherein the coating has surface roughness with a maximum peak height Sp of not more than 6.0 μm.

4. The grain oriented electrical steel sheet according to claim 3, wherein the steel sheet has a steel composition containing, by mass, Si: 2.0 to 4.0% and Mn: 0.03 to 0.25%, with a balance being Fe and inevitable impurities.

5. The grain oriented electrical steel sheet according to claim 4, wherein the steel composition further contains at least one selected from the group consisting of, by mass, Ni: not more than 1.50%, Cr: not more than 0.50%, Cu: not more than 0.50%, P: not more than 0.100%, Sb: not more than 0.500%, Sn: not more than 0.500%, Bi: not more than 0.100%, Mo: not more than 0.100%, Nb: not more than 0.0100%, V: not more than 0.010%, Ti: not more than 0.010%, and Ta: not more than 0.010%.

6. The grain oriented electrical steel sheet according to claim 2, wherein the steel sheet has a steel composition containing, by mass, Si: 2.0 to 4.0% and Mn: 0.03 to 0.25%, with a balance being Fe and inevitable impurities.

7. The grain oriented electrical steel sheet according to claim 6, wherein the steel composition further contains at least one selected from the group consisting of, by mass, Ni: not more than 1.50%, Cr: not more than 0.50%, Cu: not more than 0.50%, P: not more than 0.100%, Sb: not more than 0.500%, Sn: not more than 0.500%, Bi: not more than 0.100%, Mo: not more than 0.100%, Nb: not more than 0.0100%, V: not more than 0.010%, Ti: not more than 0.010%, and Ta: not more than 0.010%.

8. The grain oriented electrical steel sheet according to claim 1, wherein the coating has surface roughness with a maximum peak height Sp of not more than 6.0 μm.

9. The grain oriented electrical steel sheet according to claim 8, wherein the steel sheet has a steel composition containing, by mass, Si: 2.0 to 4.0% and Mn: 0.03 to 0.25%, with a balance being Fe and inevitable impurities.

10. The grain oriented electrical steel sheet according to claim 9, wherein the steel composition further contains at least one selected from the group consisting of, by mass, Ni: not more than 1.50%, Cr: not more than 0.50%, Cu: not more than 0.50%, P: not more than 0.100%, Sb: not more than 0.500%, Sn: not more than 0.500%, Bi: not more than 0.100%, Mo: not more than 0.100%, Nb: not more than 0.0100%, V: not more than 0.010%, Ti: not more than 0.010%, and Ta: not more than 0.010%.

11. The grain oriented electrical steel sheet according to claim 1, wherein the steel sheet has a steel composition containing, by mass, Si: 2.0 to 4.0% and Mn: 0.03 to 0.25%, with a balance being Fe and inevitable impurities.

12. The grain oriented electrical steel sheet according to claim 11, wherein the steel composition further contains at least one selected from the group consisting of, by mass, Ni: not more than 1.50%, Cr: not more than 0.50%, Cu: not more than 0.50%, P: not more than 0.100%, Sb: not more than 0.500%, Sn: not more than 0.500%, Bi: not more than 0.100%, Mo: not more than 0.100%, Nb: not more than 0.0100%, V: not more than 0.010%, Ti: not more than 0.010%, and Ta: not more than 0.010%.

13. A method of producing a grain oriented electrical steel sheet comprising forming a coating on each of both surfaces of a steel sheet by applying a coating liquid to the steel sheet, followed by baking at a temperature of not lower than 700° C., and cooling, while the steel sheet is transported, wherein a forward slip r in a transport region in which the steel sheet is cooled to a temperature of not higher than 600° C. is not more than 1.7%, and wherein in the coating liquid, a molar ratio M1/S of a content of a metal element M1 to a content of a silica S in terms of $SiO_2$ is not less than 0.15, a molar ratio M2/S of a content of a metal element M2 to the content of the silica S in terms of $SiO_2$ is not more than 0.15, and a molar ratio P/S of a content of a phosphoric acid component P in terms of $P_2O_5$ to the content of the silica S in terms of $SiO_2$ is not less than 0.20, the metal element M1 being at least one selected from the group consisting of Zn, Li, Mg, and Ca, and the metal element M2 being at least one selected from the group consisting of Zr, Ti, Cr, and Al.

14. A method of evaluating a grain oriented electrical steel sheet comprising: a steel sheet; and a coating provided on each of both surfaces of the steel sheet, the method comprising conducting a rubbing test to obtain an interlaminar current value of the grain oriented electrical steel sheet after the rubbing test, and determining whether insulation property of the grain oriented electrical steel sheet is good or not based on the interlaminar current value obtained, the rubbing test being conducted by stacking two sheets of the grain oriented electrical steel sheet and rubbing the two sheets against each other to make 60 to 120 reciprocations under conditions of a surface pressure of 150 to 250 Pa, a rubbing speed of 0.05 to 0.15 m/s, and a reciprocating stroke of 30 to 70 mm.

* * * * *